US011239622B2

(12) United States Patent
Anunciacao et al.

(10) Patent No.: US 11,239,622 B2
(45) Date of Patent: Feb. 1, 2022

(54) SYSTEM FOR CONNECTING WIRES OF AN ELECTRICAL CABLE HARNESS TO AN ELECTRICAL CONNECTOR

(71) Applicant: Aptiv Technologies Limited, St. Michael (BB)

(72) Inventors: Filipe F. Anunciacao, Corroios (PT); Achim Rosemann, Wuppertal (DE); Emanuel Martins Carvalho, Feijo (PT)

(73) Assignee: APTIV TECHNOLOGIES LIMITED

( * ) Notice: Subject to any disclaimer, the term of this patent is extended or adjusted under 35 U.S.C. 154(b) by 361 days.

(21) Appl. No.: 16/249,206

(22) Filed: Jan. 16, 2019

(65) Prior Publication Data

US 2019/0237927 A1 Aug. 1, 2019

(30) Foreign Application Priority Data

Feb. 1, 2018 (EP) ..... 18154741

(51) Int. Cl.

| | |
|---|---|
| ***H01R 43/20*** | (2006.01) |
| ***H01R 43/28*** | (2006.01) |
| *H01R 43/052* | (2006.01) |
| *H01R 43/055* | (2006.01) |

(52) U.S. Cl.

CPC ..... *H01R 43/20* (2013.01); *H01R 43/28* (2013.01); *H01R 43/052* (2013.01); *H01R 43/055* (2013.01)

(58) Field of Classification Search

CPC .... H01R 43/052; H01R 43/055; H01R 43/20; H01R 43/28; H01R 33/90

See application file for complete search history.

(56) References Cited

U.S. PATENT DOCUMENTS

| | | | | |
|---|---|---|---|---|
| 2,998,633 A * | 9/1961 | Andren | ..... | H01R 43/052 29/33 M |
| 4,156,961 A * | 6/1979 | Agoh | ..... | H01R 43/28 29/33 M |
| 7,603,768 B2 * | 10/2009 | Viviroli | ..... | H01R 43/0488 29/33 M |

(Continued)

FOREIGN PATENT DOCUMENTS

| | | | | |
|---|---|---|---|---|
| EP | 0168141 A2 * | 1/1986 | ..... | H01R 43/01 |
| JP | 09167670 A | 6/1997 | | |
| WO | 2017038804 A1 | 3/2017 | | |

*Primary Examiner* — Peter Dungba Vo
*Assistant Examiner* — Jeffrey T Carley
(74) *Attorney, Agent, or Firm* — Billion & Armitage

(57) ABSTRACT

A system for connecting wires of an electrical cable harness to an electrical connector includes a base that defines a base plane and is configured to support a connector. The system also includes a guiding device having first and second moveable gripping portions. The first and second gripping portions cooperate to define one or more channels that extend perpendicularly to the base plane and are configured to receive one or more wire ends for insertion. An inner surface of the first gripping portion is parallel with a corresponding inner surface of the second gripping portion and an outer surface of the first gripping portion is nonparallel with a corresponding outer surface of the second gripping portion. The system further includes a robotic arm configured to move the guiding device relative to the base while the one or more channels remain perpendicular to the base plane.

12 Claims, 7 Drawing Sheets

(56) References Cited

U.S. PATENT DOCUMENTS

| | | | | |
|---|---|---|---|---|
| 8,979,155 | B2 * | 3/2015 | Hedrick | B25J 15/0042 294/207 |
| 2001/0000367 | A1 * | 4/2001 | Conte | H01R 43/28 29/868 |
| 2001/0035039 | A1 * | 11/2001 | Ooji | H01R 43/055 72/420 |
| 2004/0103531 | A1 * | 6/2004 | Shirakawa | H01R 43/20 29/857 |
| 2005/0050713 | A1 * | 3/2005 | Locher | H02G 1/1268 29/564.4 |
| 2005/0050722 | A1 * | 3/2005 | Viviroli | H01R 43/052 29/729 |
| 2006/0064870 | A1 * | 3/2006 | Furuya | H01R 43/20 29/747 |
| 2007/0082558 | A1 * | 4/2007 | Carlotto | H01R 43/052 439/752 |
| 2009/0025208 | A1 * | 1/2009 | Karrasch | H01R 43/28 29/748 |
| 2011/0097185 | A1 * | 4/2011 | Braun | H01R 43/20 414/800 |
| 2014/0081464 | A1 * | 3/2014 | Lu | G01N 21/952 700/275 |
| 2014/0109385 | A1 * | 4/2014 | Lu | H01R 43/0263 29/559 |
| 2019/0356099 | A1 * | 11/2019 | Lo | H01B 13/0036 |

* cited by examiner

SYSTEM FOR CONNECTING WIRES OF AN ELECTRICAL CABLE HARNESS TO AN ELECTRICAL CONNECTOR

CROSS-REFERENCE TO RELATED APPLICATION

This application claims the benefit under 35 U.S.C. § 119(a) of Patent Application No. 18154741.5 filed in the European Patent Office on Feb. 1, 2018, the entire disclosure of which is hereby incorporated by reference.

TECHNICAL FIELD OF THE INVENTION

The present disclosure relates to an assisted method of electrically connecting a plurality of wires to a connector and to a corresponding assembly system. More specifically, the present disclosure relates to assembly methods and systems for electrically connecting the wires of a cable harness to a connector.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
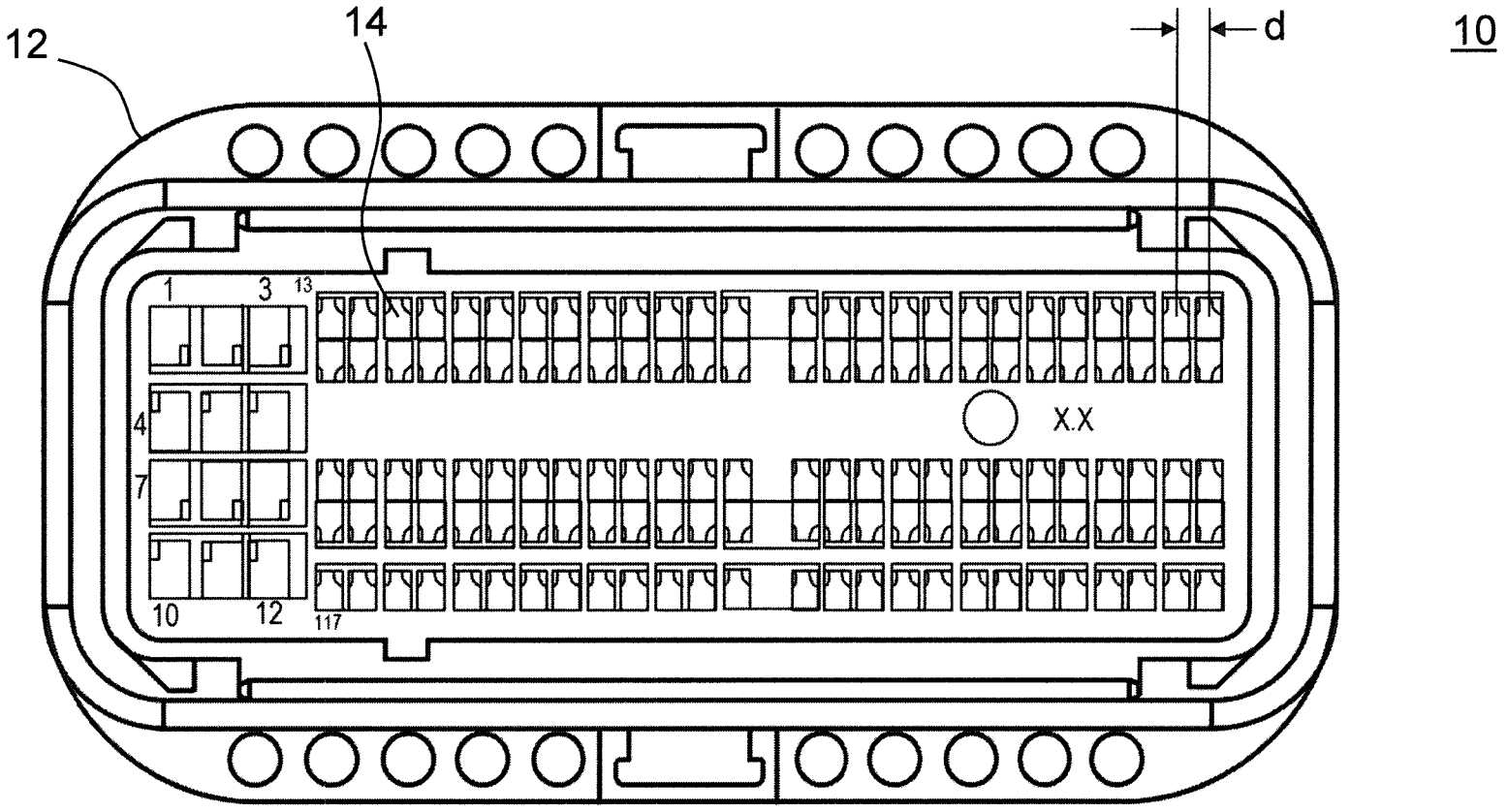
FIG. 1 shows an example of a connector or connector housing to which wires can be connected according to an embodiment of the invention.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

The present disclosure provides a method of electrically connecting a plurality of wires to connector that is based on robot or machine-assisted manual assembly. In the method of claim 1, a connector comprising a plurality of cavities is initially secured onto a base. A predetermined connecting sequence is loaded onto the memory of a guiding device that assists the assembly worker (hereinafter "user").

Each step of the connecting sequence includes the location of one or more cavities of the connector that is configured to receive a wire, for example an end of a wire fitted with a terminal. For the sake of simplicity, the following disclosure refers to the ends of the wire, which also includes the terminals for connecting the wire to the housing. Next, a plurality of wires that each correspond to the respective steps of the connecting sequence are prepared. The connecting sequence is then started to automatically move the guiding device into place. This means that one or more channels defined by the guiding device are aligned with one or more cavities indicated in the first step of the connecting sequence such that the wire end can be guided through each channel and into the aligned cavity.

After the automatic aligning step, the user manually guides the end of the wire through the channel of the guiding device and into the aligned cavity to electrically connect or plug the wire. If the wire has multiple ends, each of the wire ends is guided through a corresponding channel and into an aligned cavity. In this way, the guiding device indicates the correct cavity for receiving a specific wire end to the user in a clear and simple manner. This reduces the likelihood that the wire end is plugged into the wrong cavity. Furthermore, the channel of the guiding device reduces the likelihood that the wire end or terminal is inserted at an angle that may cause the wire to bend or break. Once the wire has been plugged into the corresponding cavity, the wire is both electrically and mechanically connected to the connector, so the guiding device releases the wire to align the channel with the next cavity defined by the connecting sequence. The automatic aligning step, the manual guiding and connecting step and the automatic release step are repeated in this order until all of the steps of the connecting sequence have been executed.

The assisted assembly method of the present disclosure combines both manual and automatic assembly steps to improve output and quality while also maintaining the flexibility and lower assembly costs associated with a manual assembly process. Additionally, the method can be easily combined with existing methods to partially automate the cable harness assembly process, for example with systems and machines for automatically cutting wires and/or assembling terminals to the ends of wires.

Further embodiments and advantages of the assembly method are defined by the dependent claims and described in the following:

In some cases, the cable harness assembly process may incorporate cavity plugs for sealing cavities that are not configured to receive a wire end or terminal. Accordingly, an embodiment of the method may include the further steps of loading a predetermined plugging sequence on to the controller of the guiding device, with each step of the plugging sequence defining the location of one or more cavities that are not included in the connecting sequence. The plugging sequence is automatically started to move the guiding device to align the one or more channels with the one or respective cavities corresponding to the first step of the plugging sequence. The user then manually inserts a cavity plugs through the one or more channels and into the corresponding one or more cavities. The automatic aligning step and the manual plugging step are repeated until all of the steps of the plugging sequence of been executed. At this point, the connecting sequence can then be started. Using an assisted process for inserting cavity plugs eliminates the time necessary to correct the placement of cavity plugs before the wires can be plugged in or connected.

A further way of reducing process time is to manually guide both ends of a wire comprising a twisted pair through corresponding channels of the guiding device into the respective cavities at the same time. This embodiment is also advantageous over a fully automated assembly system, which may be unable to handle wires having more than one terminal attached to its end.

According to one embodiment, the releasing step can automatically occur once a specific amount of time has elapsed since the aligning step. This variation can stabilize the cycle times for assembly to reduce overall assembly time. However, the user may also need additional time to complete the manual guiding step, for example during training. In this case, the releasing step may optionally depend from a release signal provided to a controller of the guiding device, for example, by means of a button or a pedal.

The present disclosure also provides an assisted assembly system that comprises a base, which defines a base plane and is configured to support a connector, and a guiding device that includes first and second moveable gripping portions and an actuator for moving the gripping portions between an open and closed position, for example a servo drive or a pneumatic or hydraulic actuator. The gripping portions are configured to cooperate in the closed position to define one or more channels that extend perpendicularly to the base plane and are configured to receive one or more wire ends for manual insertion into connector cavities, while the actuator opens the gripping portions to release an inserted wire. The assembly system also comprises driving means for moving the base and/or the guiding device relative to each other, with the one or more channels remaining perpendicular to the base plane in order to automatically align the one or more channels with the respective connector cavities corresponding to the aforementioned sequence steps. Finally, the assembly system comprises a controller configured to control the driving means and the actuator of the gripping portions according to a predetermined sequence, for example the aforementioned connecting sequence and the optional plugging sequence.

The system of the present disclosure provides the necessary guidance and assistance for cable harness connector assembly, but is simple to implement. This reduces assembly error and improves quality over completely manual assembly systems without incurring the high start-up costs of fully automated assembly systems.

Further embodiments and advantages of the assisted assembly system are defined by the dependent claims and are described below.

In one embodiment, the driving means are configured to move the base within the base plane. For example, the base can be a motorized tray or board that provides movement within and perpendicular to the base plane, while the guiding device does not change its position relative to the base plane.

In another embodiment, the driving means may be configured to move the guiding device parallel and/or perpendicular to the base plane, for example, while the base remains stationary. Such arrangements may be perceived as more pleasant to use and provide ergonomic advantages. For example, a robot arm connected to the guiding device may form part of the driving means, as reasonably priced robot arms are available on the market. A robot arm can also be used to pivot the guiding device about an axis perpendicular to the base plane. This movement of the guiding device makes it possible to accommodate different orientations of terminals, in particular for twisted pair, jacketed or triple wires. In addition to a robot arm, other suitable means may be used to pivot the guiding device about an axis.

In addition to embodiments in which either the base or the guiding device are configured to remove while the other remains stationary, an embodiment in which the driving means are configured to move both the base and the guiding device relative to one another is conceivable. For example, the base may be configured to move within the base plane while the guiding device is configured to pivot about an axis that extends perpendicularly to the base plane.

In one embodiment, a contour of the one or more channels defined by the gripping portions may include a shape-matching feature that assists the user in the orientation of the wire end, particularly with a terminal attached to the wire end. For example, the channel may have the same contour as the outer contour of the connector cavity. Additionally or alternatively, the gripping portions may comprise opposing surfaces that are configured to abut one another when the gripping portions are closed, which defines one or more closed channels for guiding the end of a wire into a corresponding connector cavity. This feature is particularly advantageous in conjunction with the shape-matched contour of the channel. However, even if there is a minor gap between the opposing surfaces of the gripping portions, the guiding device is still able to assist the user in assembling the connector.

In another embodiment, the guiding device may include mounting means for mounting the guiding device. The mounting means make it possible to produce a custom-made gripping device and attach it to readily available driving means, such as a robot arm. This embodiment may include any suitable known mounting means, for example a screwed connection, but it may particularly include mounting means that can be operated without tools, such as a shape-matched or snap-fit connection. Mounting means that can be operated without tools make it possible for the user to switch out different guiding devices while keeping the same driving means to provide a simple and relatively inexpensive modular assembly system. Switching out different guiding devices may be made easier if the first and second gripping portions are connected to one another to form a single removable unit. For example, the gripping portions may include a spring-loaded or biased connection that biases the gripping portions in their closed position, and the actuator acts against the biasing force to open the gripping portions and automatically release the inserted wire(s).

In one embodiment, the guiding device may include a removable attachment portion that defines one or more apertures that extend in parallel to the channels defined by the gripping portions. Preferably, this attachment portion can be attached to the guiding device without the use of tools, such as by shape-matched or snap-fit connection. The attachment portion may be convenient for plugging cavity plugs into some of the connector cavities before the wires are inserted through the channel(s) of the gripping portions.

In another embodiment, the gripping portions may be asymmetric about a plane extending perpendicularly to the base plane. Such an asymmetry may be used to form an outer contour of the channel(s) that is shape-matched to the cavity contour or the outer contour of the terminals. However, the asymmetry of the gripping portions may also include one outer edge of the gripping portion that extends in parallel to said plane while the other outer edge is arranged at an angle. The angled outer edge may form a trailing edge that accommodates previously inserted wires as the guiding device moves from one cavity to the next. In any case, the gripping portions may also be symmetric about the aforementioned plane, i.e. formed in mirror image. Such symmetric gripping portions may be simple to manufacture.

In yet a further embodiment, the system may comprise an input device, e.g. a button or a foot pedal, for sending a release signal to the controller to release an inserted wire from the channel of the guiding device. This embodiment allows the user to determine the speed of the connecting sequence, e.g. during training.

FIG. 1 shows an example of a connector 10 for a cable harness that includes a housing 12 and a plurality of cavities 14 that are configured to receive a cavity plug or a terminal attached to the end of a wire. In some cases, the terminals may be small and delicate and have outer dimensions as small as 0.6 mm. At the same time, the total distance "d" between two adjacent cavities 14 may be less than 2 mm, which increases eyestrain for the user and increases the likelihood of incorrectly plugged terminals and cavity plugs.

FIG. 2 shows a schematic overview of a method and a system 20 for assisted plugging or connection of wires 16 that reduces plugging error. For the sake of simplicity, the wires 16 in the drawing have been shown without terminals crimped to their ends. However, the method and system of the present disclosure are applicable to wires that include terminals. A connector 10 rests on a base 22 that defines a horizontal base plane B. Though FIG. 2 shows the base 22 and the base plane B extending substantially horizontally, they may also be oriented at an angle depending on the configuration of a particular workspace. A partial cross-section through the housing 12 shows a plurality of cavities 14 that are arranged next to one another.

Figure 2A:
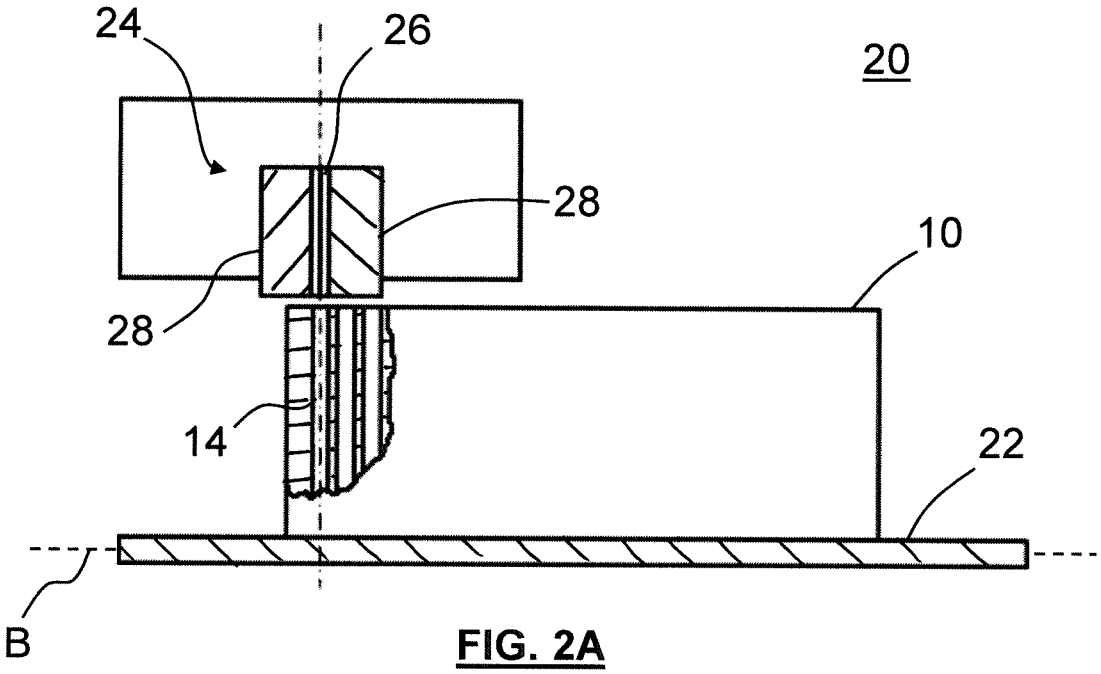
FIGS. 2A, 2B, 2C, and 2D provide a schematic overview of an assisted assembly method according to an embodiment of the invention.

The system 20 also includes a guiding device 24 that is arranged vertically above the connector 10 and includes a channel 26 that is aligned with one of the cavities 14 of the connector 10, as indicated by the dashed line in FIG. 2A. The channel 26 is defined by a pair of gripping portions 28 that are configured to cooperate with one another. FIGS. 2A to 2D each show a cross-section through the gripping portions 28.

Figure 2B:
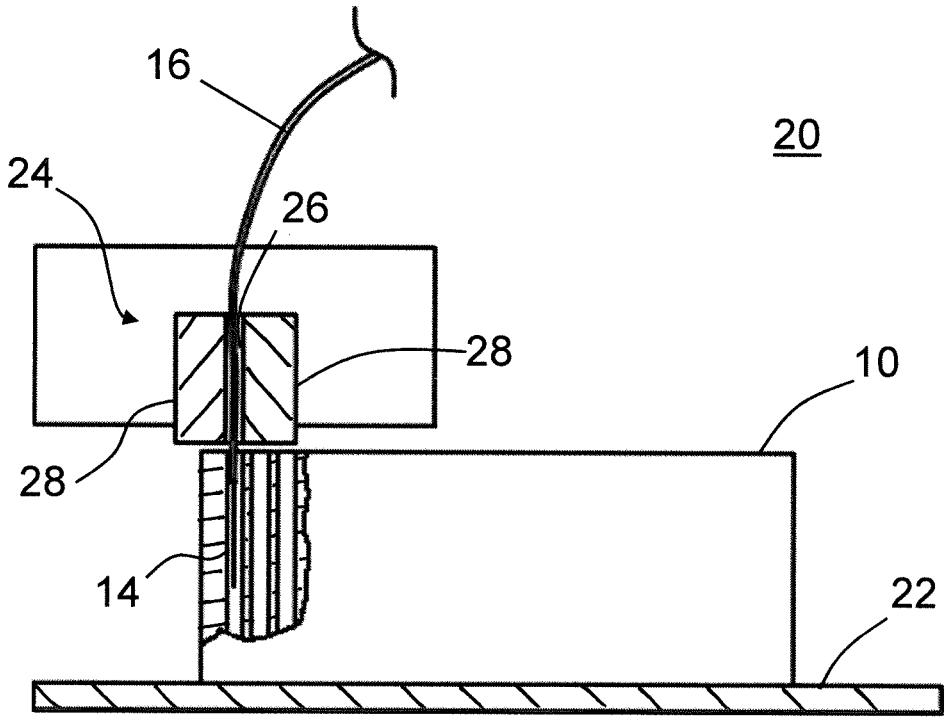
Figure 2C:
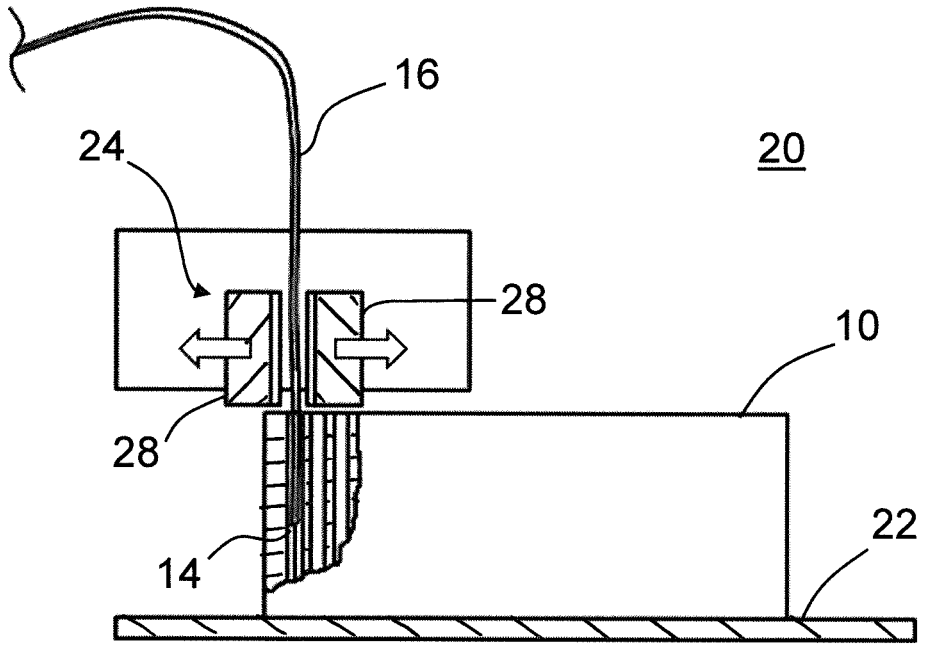

In FIG. 2A, the leftmost cavity 14 of the connector corresponds to a first cavity of a pre-loaded connecting sequence, and the position of the guiding device 24 corresponds to the start of the automatic connecting sequence. FIG. 2B shows the next step of the connecting process in which the end of a wire 16 is inserted by hand (not shown) through the channel 26 and into the corresponding cavity 14. Once the wire 16 has been inserted into the cavity 14 and electrically connected to the connector 10, the gripping portions 28 of the guiding device 24 enclose the wire 16 in the same way as a bead threaded onto a string (see FIG. 2B). In order to release the wire 16, the movement arrows in FIG. 2C show the gripping portions 28 moving apart from one another as moved by an actuator (not illustrated) to automatically release the wire 16 from the channel 26. The actuator for the guiding device 24 may be a servo drive, but pneumatic or hydraulic actuators can also be used. Generally speaking, the actuator may be configured to open the gripping portions 28 after a certain amount of time has elapsed. However, it is also possible for the actuator to be configured to open the gripping portions 28 in response to a release signal provided by the user via a controller of the system. The release signal may be generated when the user pushes a button or activates a pedal (not shown).

After opening to release the first wire 16 (see FIG. 2C), the gripping portions 28 move in a direction perpendicular to the page and are closed again. The gripping portions 28 may be closed again by the actuator, but alternatively the gripping portions 28 could include connecting means that bias the gripping portions 28 in a closed position. The actuator could then be activated to counteract the biasing force long enough for the gripping portions 28 to release the inserted wire 16, whereupon the biasing force returns the gripping portions 28 to their closed position.

Figure 2D:
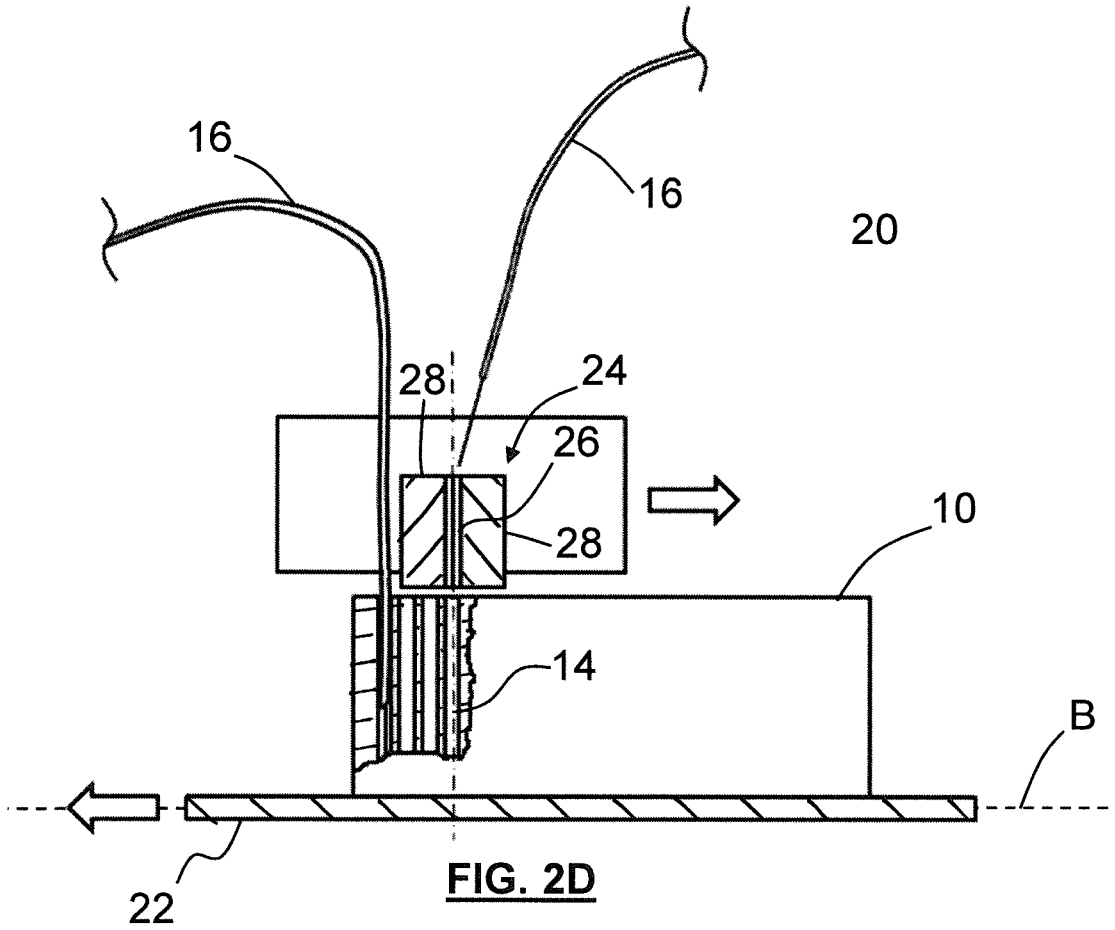

The channel 26 is then aligned with a further cavity 14 so that a subsequent wire 16 can be inserted into the cavity 14 (see FIG. 2D). FIG. 2D shows two movement arrows that indicate relative movement between the base 22 and the guiding device 24 to align the channel 26 with the next cavity. Generally speaking, the base 22 may move relative to the guiding device 24 or vice versa, or both the base 22 and the guiding device 24 may be configured for relative movement. In any case, the controller of the system 20 controls driving means for the base 22 and/or the guiding device 24 together with the actuator for the gripping portions 28 to sequentially move along a series of cavities 14 to ensure that the user inserts wires into the correct cavities 14.

Figure 3:
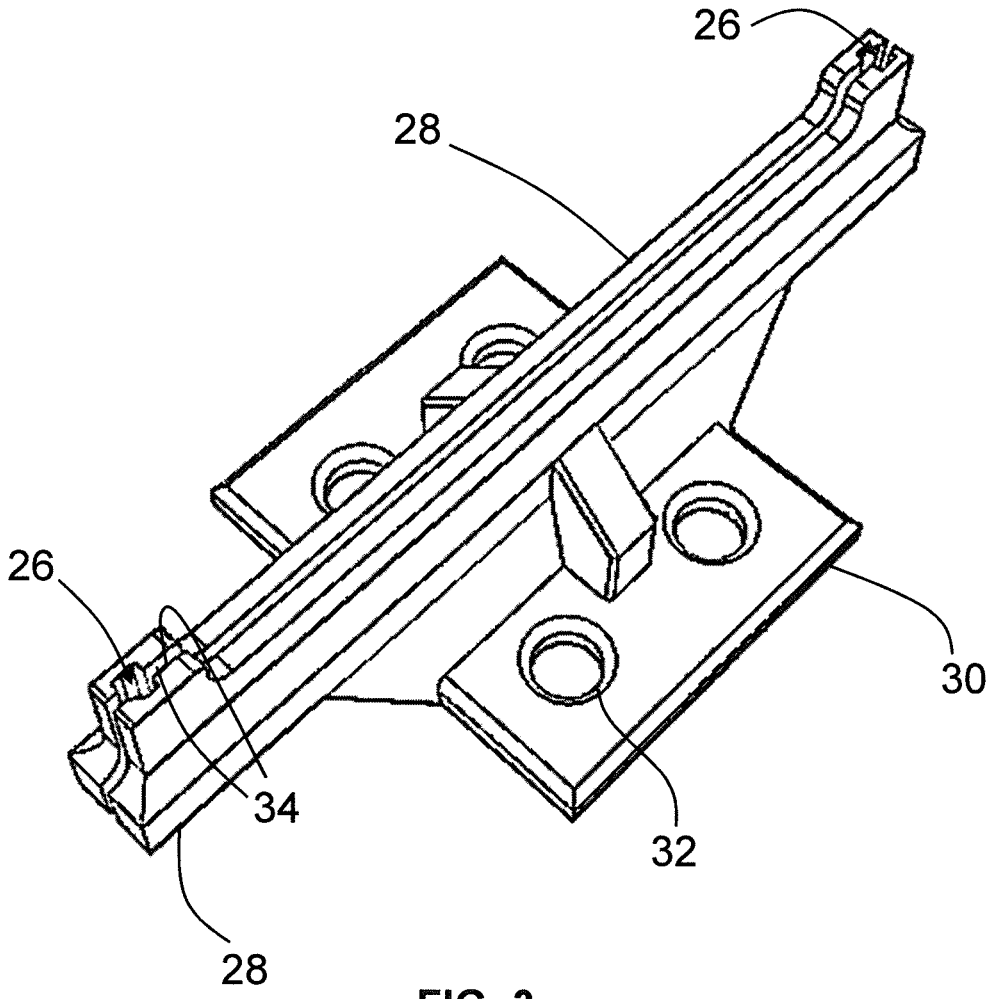
FIGS. 3, 4, 5A, and 5B provide schematic illustrations of different gripping portions according to an embodiment of the invention.

FIG. 3 shows an example of gripping portions 28. Each of the gripping portions 28 is provided with mounting means in the form of a base plate 30 for attaching the gripping portion 28 to drive means or to a stationary assembly via mounting holes 32. As an alternative to mounting holes 32, it is also conceivable to provide means for a shape-matched or snap-fit connection. The gripping portions 28 cooperate to define two channels 26 that are arranged at opposite ends of the gripping portions 28. The channels 26 in FIG. 3 have a contour that provides shape matching to the cavities 14 of the connector, as will be explained in more detail in reference to FIG. 5. Though FIG. 3 illustrates a slight gap between the respective gripping portions 28, the gripping portions 28 can be configured so that opposing surfaces 34 that define the contour of the respective channels 26 abut each other to form a closed channel 26, i.e. a channel 26 having a closed contour.

Figure 4:
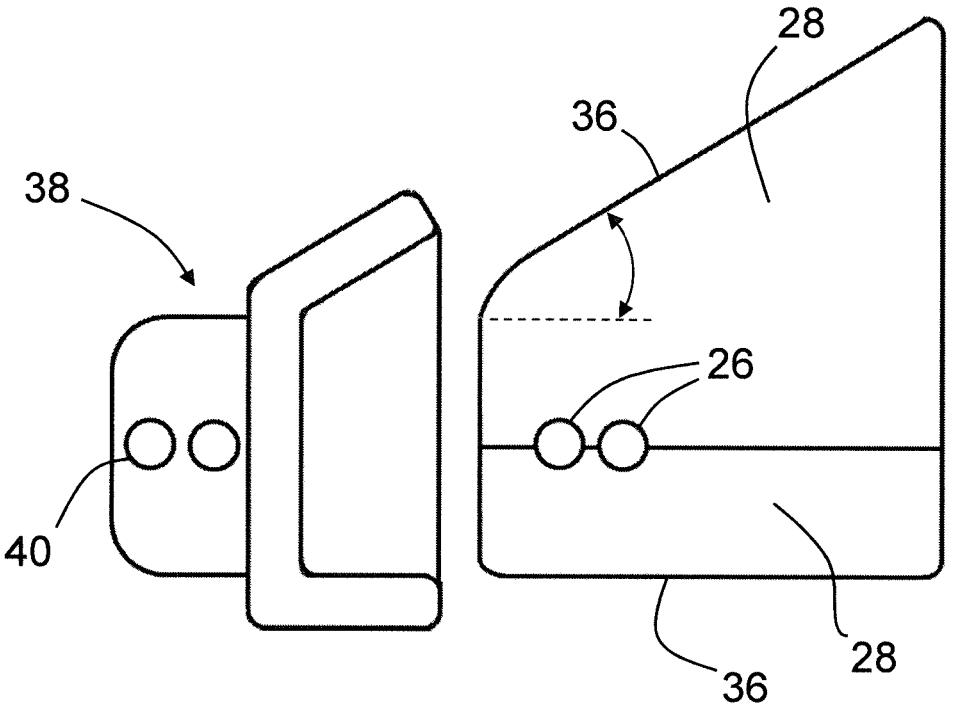

FIG. 4 shows a further example of gripping portions 28. Unlike the two channels 26 shown in FIG. 3, the channels 26 shown in FIG. 4 are arranged closer together, for example in order to accommodate the two wires of a twisted pair (see also FIG. 6). Furthermore, the gripping portions 28 have asymmetric outer edges 36, with one edge 36 extending in parallel to the top and bottom edges of the page, while the other edge 36 extends at an angle to form a substantially triangular shape. When the gripping portions 28 shown in FIG. 4 are mounted to a guiding device 24, the slanted edge 36 may accommodate previously plugged wires 16 as the guiding device 24 and the base 22 move relative to one another.

FIG. 4 also shows a removable attachment portion 38 that is configured to slide onto the outer edges 36 of the gripping portions 28. The attachment portion 38 defines two further apertures 40 that are aligned with and extend in parallel to the channels 26. The attachment portion 38 is formed integrally as a monolithic component, for example by injection molding. In other words, the apertures 40 of the attachment portion 38 cannot automatically release a wire 16 in the same manner as the moveable gripping portions 28. However, the attachment portion 38 may be useful for inserting cavity plugs into cavities 14 that are not configured to receive a wire and terminal. The cavity plugs are inserted through and out the bottom of the aperture 40 so that the plugs do not remain in contact with the attachment portion 38. Though FIG. 4 illustrates the channels 26 and the apertures 40 as having the same circular contour, it is also conceivable that the channels 26 and the apertures 40 have different contours.

Figure 5A:
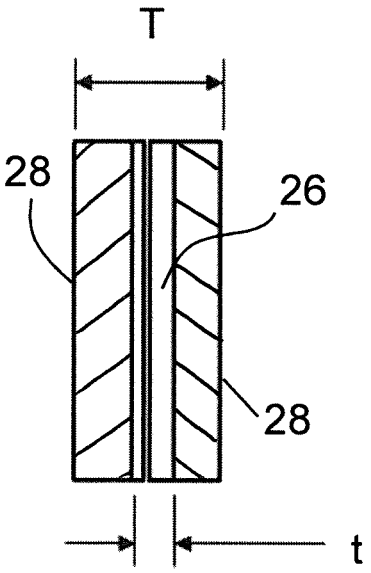
Figure 5B:
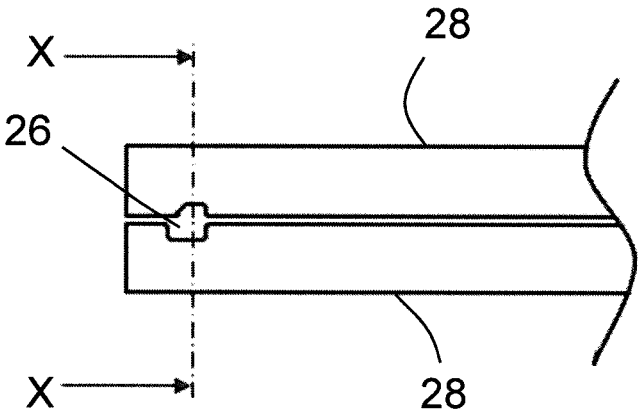

FIG. 5 shows a partial top view and a cross-section through further gripping portions 28 that define a channel 26 with a shape-matched feature similar to the channels 26 in FIG. 3. While one of the gripping portions 28 has a substantially rectangular indentation when seen in the top view, the other gripping portion 28 has a trapezoidal indentation that matches the rectangular indentation of the other gripping portion 28. Together, the gripping portions 28 define a channel 26 whose outer contour has five sides that correspond roughly to the shape of a connector cavity 14, as shown in FIG. 1. When the ends of a wire 16 are provided with a terminal, such a shape-matching feature helps the user to insert the terminal through the channel 26 and into the cavity 14 with the correct orientation, which prevents damage and assembly error.

The cross-section in FIG. 5 also shows the relationship between the combined thickness T of the gripping portions 28 in relation to the thickness t of the channel 26. The illustrated gripping portions have a relatively small thickness ratio t/T of approximately 1.5 to 2.0, which is useful when assembling cable harness connectors 10 with many small cavities 14 that are arranged close to one another. When the thickness ratio t/T is substantially larger, it may be difficult to move through the steps of the connecting sequence while accommodating the wires 16 that have already been plugged into the connector 10.

Figure 6A:
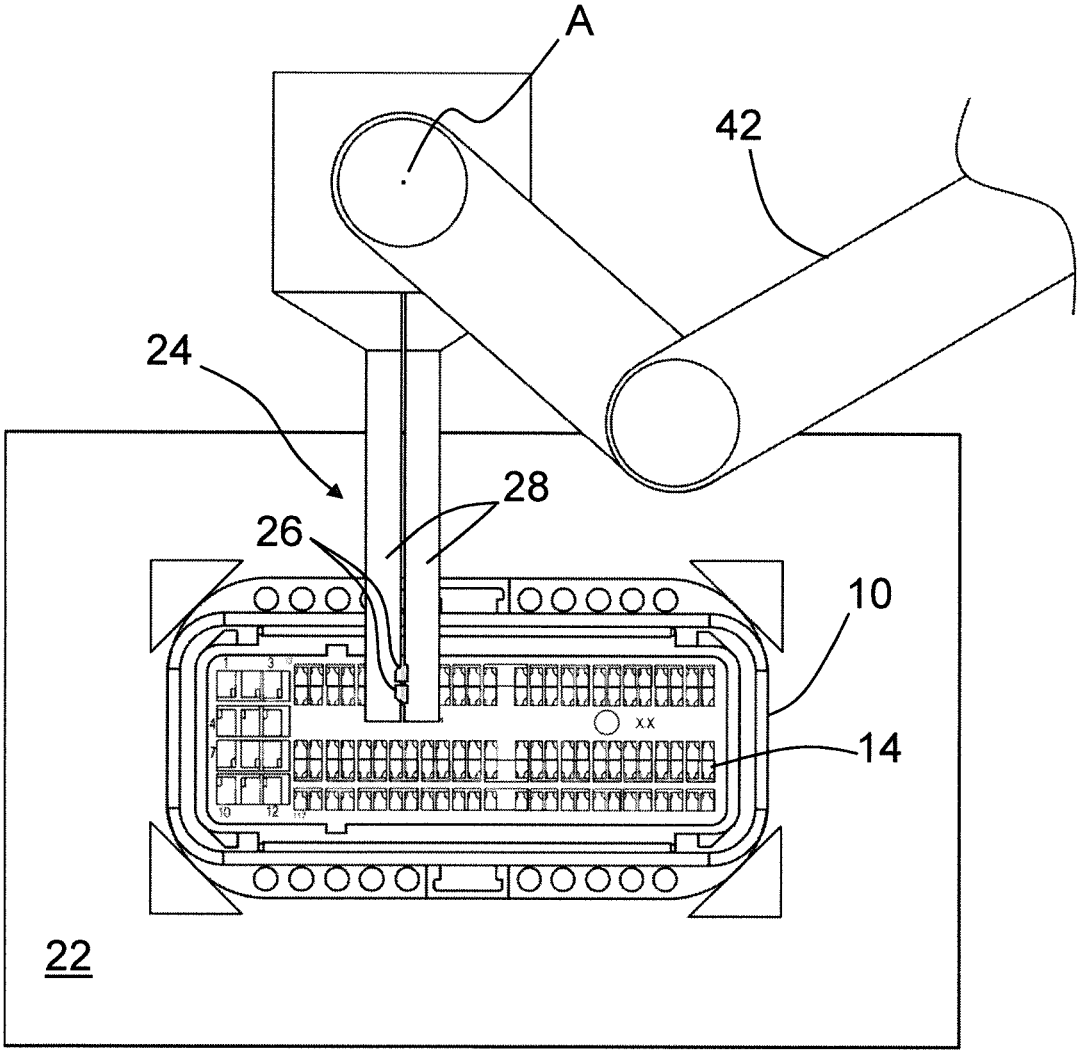
FIGS. 6A and 6B shows an embodiment of an assisted assembly system that can accommodate twisted pair, triple or jacketed wires according to an embodiment of the invention.

FIG. 6A shows an embodiment of a system 20 from above, in which the guiding device 24 is connected to a robot arm 42 that forms driving means that move the guiding device 24 relative to the base 22 and the connector 10. One particular aspect of a robot arm 42 is that it enables the gripping portions 28 of the guiding device 24 to pivot about an axis that is perpendicular to the page. This functionality is useful for accommodating twisted pairs, triple or jacket wires, as is shown schematically in the side view of FIG. 6B.

Figure 6B:
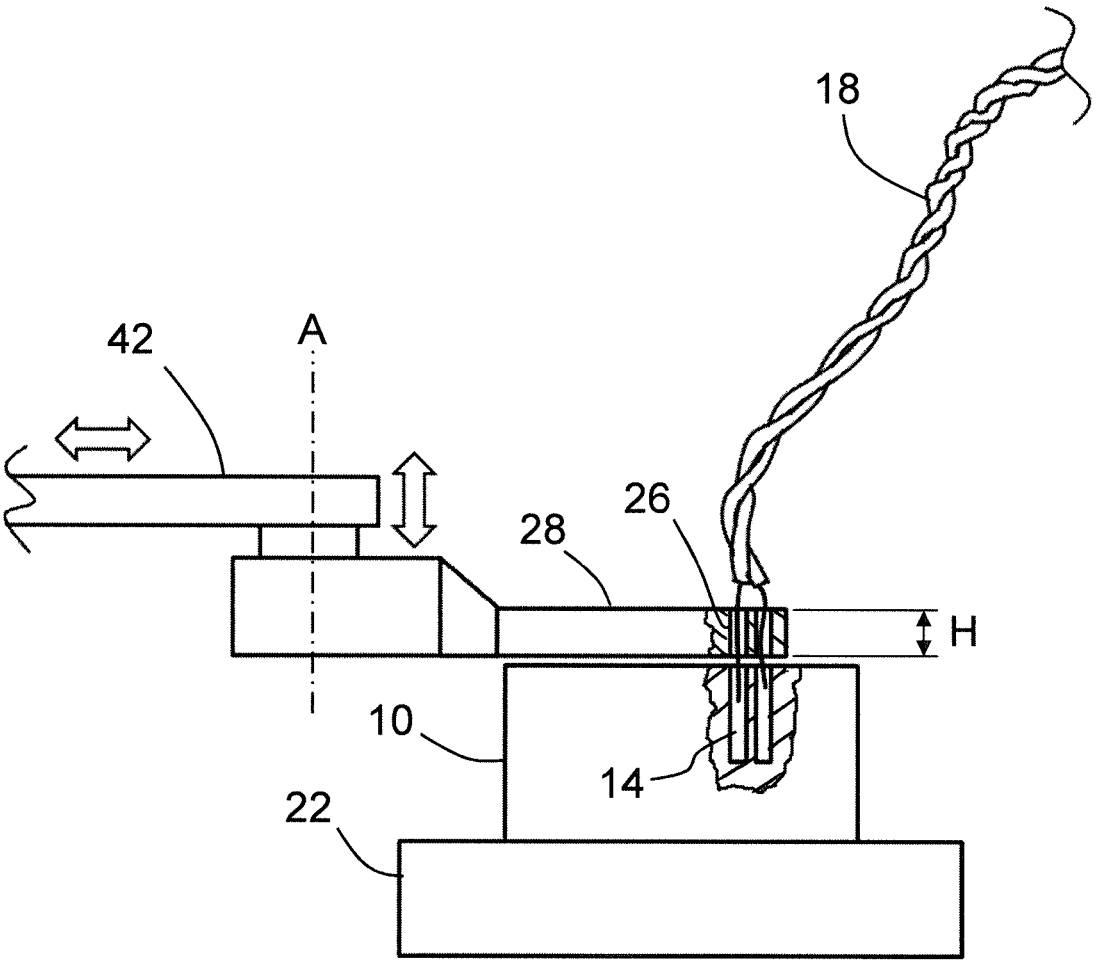

The partial cross section of FIG. 6B shows both ends of a twisted pair of wires 18 being simultaneously inserted into two adjacent cavities 14 of the connector 10. While the adjacent cavities 14 for some twisted pairs may correspond to the orientation of the channels 26 shown in FIGS. 6A and 6B, other wires may require adjacent cavities 14 that are arranged at a 90 degree angle to the illustrated orientation of the gripping portions 28. In this case, the robot arm 42 may pivot the entire guiding device 24 about an axis A to orient the channels 26 with the appropriate pair of adjacent cavities 14.

The cross-sectional view of FIG. 6B also schematically illustrates a low height H of the gripping portions 28 that is designed to accommodate the relatively short open or stripped ends of the twisted pair of wires 18. However, for other applications, it is imaginable that a slightly taller set of gripping portions 28 may ensure correct vertical insertion of the wire to prevent bending or defects. In other words, it may be advantageous to provide multiple guiding devices 24 having different heights H or thicknesses T that are better suited to specific assembly applications.

While the previous disclosure describes an assisted system 20 and assembly method in the specific context of cable harnesses, the disclosure is not limited to such applications and may also prove advantageous in other applications that require the electrical connection of wires or cables to a connector or connector housing.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An assembly system, comprising:

a base that defines a base plane and is configured to support a connector having one or more cavities;

a driving means configured to move the base within the base plane;

a guiding device having first and second moveable gripping portions, wherein the first and second gripping portions cooperate to define one or more channels that extend perpendicularly to the base plane and are configured to receive one or more wire ends for insertion and wherein an inner surface of the first gripping portion is parallel with a corresponding inner surface of the second gripping portion and an outer surface of the first gripping portion is nonparallel with a corresponding outer surface of the second gripping portion, the first and second moveable gripping portion having attachment portions configured for inserting cavity plugs into one or more cavities;

a robotic arm configured to move the guiding device relative to the base while the one or more channels remain perpendicular to the base plane; and a controller configured to control the robotic arm and the first and second gripping portions according to a predetermined connecting sequence which includes a location of one or more of the cavities of the connector that is configured to receive a wire and a predetermined plugging sequence which includes a location of one or more of the cavities of the connector that are not included in the connecting sequence and will receive a cavity plug rather than a wire.

2. The system according to claim 1, wherein the robotic arm is configured to move the guiding device in a direction parallel to the base plane.

3. The system according to claim 1, wherein the robotic arm is configured to pivot the first and second gripping portions about an axis perpendicular to the base plane.

4. The system according to claim 1, wherein the robotic arm is configured to move the guiding device in a direction perpendicular to the base plane.

5. The system according to claim 1, wherein the one or more channels are contoured to match a shape of the one or more cavities of the connector.

6. The system according to claim 1, wherein inner surfaces of the gripping portions are configured to abut one another when the gripping portions are closed.

7. The system according to claim 1, wherein the guiding device includes a means for mounting the guiding device.

8. The system according to claim 1, wherein the gripping portions are connected to one another.

9. The system according to claim 1, wherein the guiding device further includes a removable attachment portion that defines one or more apertures that extend in parallel to the one or more channels.

10. The system according to claim 1, wherein the outer surface of the first gripping portion extends at an acute angle relative to the outer surface of the second gripping portion.

11. The system according to claim 1, wherein a ratio of a combined thickness of the first and second gripping portions to a combined thickness of the one or more channels is in a range of 3:2 to 2:1.

12. The system according to claim 1, wherein the outer surface of the first gripping portion is slanted in relation to the corresponding outer surface of the second gripping portion.

* * * * *